US009441552B2

(12) United States Patent
Coplin et al.

(10) Patent No.: US 9,441,552 B2
(45) Date of Patent: Sep. 13, 2016

(54) METHOD OF INJECTING FUEL INTO AN ENGINE

(75) Inventors: Nicholas Coplin, Merriwa (AU); Geoffrey Paul Cathcart, Mount Lawley (AU)

(73) Assignee: Orbital Australia Pty Limited, Balcatta, Western Australia (AU)

( * ) Notice: Subject to any disclaimer, the term of this patent is extended or adjusted under 35 U.S.C. 154(b) by 263 days.

(21) Appl. No.: 13/807,168

(22) PCT Filed: Jun. 30, 2011

(86) PCT No.: PCT/AU2011/000798

§ 371 (c)(1),
(2), (4) Date: Feb. 13, 2013

(87) PCT Pub. No.: WO2012/000029

PCT Pub. Date: Jan. 5, 2012

(65) Prior Publication Data

US 2013/0144512 A1 Jun. 6, 2013

(30) Foreign Application Priority Data

Jul. 1, 2010 (AU) ..... 2010902920

(51) Int. Cl.

| | |
|---|---|
| ***F02M 67/12*** | (2006.01) |
| ***F02M 67/02*** | (2006.01) |
| ***F02D 19/08*** | (2006.01) |
| ***F02D 41/24*** | (2006.01) |
| *F02D 41/00* | (2006.01) |
| *F02D 41/30* | (2006.01) |
| *F02M 23/00* | (2006.01) |

(52) U.S. Cl.

CPC ..... *F02D 19/08* (2013.01); *F02D 41/2467* (2013.01); *F02M 67/02* (2013.01); *F02M 67/12* (2013.01); *F02D 41/0025* (2013.01); *F02D 2041/3088* (2013.01); *F02M 2023/008* (2013.01)

(58) Field of Classification Search

CPC ..... F02D 41/0025; F02D 41/2422; F02D 67/12; F02D 67/02; F02D 19/10

USPC ..... 123/525, 526, 531, 533, 299, 1 A

See application file for complete search history.

(56) References Cited

U.S. PATENT DOCUMENTS 4,800,862 A * 1/1989 McKay et al. ..... 123/531
4,934,329 A * 6/1990 Lear et al. ..... 123/531

(Continued)

OTHER PUBLICATIONS

ISR for related PCT/AU2011/000798 mailed on Sep. 28, 2011.

(Continued)

*Primary Examiner* — Lindsay Low
*Assistant Examiner* — George Jin
(74) *Attorney, Agent, or Firm* — Ladas & Parry, LLP

(57) ABSTRACT

A method of operation of a dual fluid fuel injection system arranged to supply fuel to a cylinder of an internal combustion engine, the dual fluid fuel injection system being controllable to effect fuel metering events and fuel delivery events. The method comprises operating the dual fluid fuel injection system so as to have at least one fuel delivery event during each engine cycle and to have fewer than one fuel metering event, on average, per engine cycle. An electronic control unit for implementing the method is also described. The method and control unit allow dynamic range of a fuel metering injector, where included within the dual fluid fuel injection system, to be extended.

17 Claims, 6 Drawing Sheets

(56) References Cited

U.S. PATENT DOCUMENTS

| | | | | |
|---|---|---|---|---|
| 5,095,873 | A * | 3/1992 | Motoyama et al. | 123/305 |
| 5,603,301 | A * | 2/1997 | Sakurai et al. | 123/430 |
| 5,711,281 | A * | 1/1998 | Lorraine | F02M 69/047 123/531 |
| 5,769,041 | A | 6/1998 | Suzuki | 123/73 C |
| 6,564,770 | B1 * | 5/2003 | Cathcart | 123/299 |
| 6,920,861 | B2 * | 7/2005 | Hayakawa et al. | 123/295 |
| 7,027,907 | B2 | 4/2006 | Le Gall | 701/105 |
| 7,715,974 | B2 * | 5/2010 | Gibson et al. | 701/103 |
| 2002/0002967 | A1 * | 1/2002 | Paul et al. | 123/525 |
| 2006/0207567 | A1 * | 9/2006 | Yamaguchi et al. | 123/431 |
| 2006/0259227 | A1 * | 11/2006 | Fritsch et al. | 701/104 |
| 2008/0017173 | A1 * | 1/2008 | Fujii | 123/478 |
| 2010/0126468 | A1 * | 5/2010 | Martin | 123/447 |
| 2010/0147262 | A1 * | 6/2010 | Martin et al. | 123/299 |
| 2010/0318277 | A1 * | 12/2010 | Pursifull et al. | 701/103 |
| 2011/0251776 | A1 * | 10/2011 | Bartell et al. | 701/103 |
| 2012/0111301 | A1 * | 5/2012 | Basaki et al. | 123/295 |

OTHER PUBLICATIONS

IPRP along with Amended claims and letter for related PCT/AU2011/000798 completed on Oct. 15, 2012.

PCT Written Opinion of the International Searching Authority mailed on Sep. 28, 2011 for related PCT Application No. PCT/AU2011/000798.

PCT Written Opinion of the International Preliminary Examining Authority mailed Aug. 6, 2012 for related PCT Application No. PCT/AU2011/000798.

Carson, C., et al., "Ram-Tuned and Air-Assisted Direct Fuel Injection Systems Applied to a SI Two-Stroke Engine," SAE Technical Paper 950269, 1995 (12 pages).

* cited by examiner

METHOD OF INJECTING FUEL INTO AN ENGINE

CROSS-REFERENCE TO RELATED APPLICATION

This application is the U.S. national state of international patent application no. PCT/AU2011/000798 filed on Jun. 30, 2011, which claims priority to Australian patent application no 2010902920 filed on Jul. 1, 2010, the disclosures of which are hereby incorporated by reference in their entireties.

FIELD OF THE INVENTION

The present invention relates to the use of a dual fluid injection system for the delivery of fuel to an internal combustion engine.

BACKGROUND TO THE INVENTION

The use of dual fluid fuel injection systems in internal combustion engines is known in the art. A dual fluid injection system facilitates the delivery of both fuel and air into an engine cylinder during an engine operating cycle or "engine cycle". During each engine cycle, there are thus generally two events which occur in a dual fluid fuel injection system: a fuel metering event, where a requisite quantity of fuel is typically provided by a fuel metering injector to a delivery or air injector; and an air injection or fuel delivery event, where compressed air is supplied through the delivery or air injector into the engine cylinder, with the metered quantity of fuel being delivered by and entrained in the supplied air.

Dual fluid fuel injection systems have proved efficient at providing good control over engine operation. The metering of the fuel, and the timing of the air injection or delivery event, can both be finely adjusted in response to engine load and other prevailing engine operating conditions. As a result, the engine can be operated efficiently, with engine emissions (particularly $NO_x$ and hydrocarbons) being kept low. Examples of dual fluid injection systems, as developed by the Applicant, are described in U.S. Pat. Nos. 4,800,862 and 6,564,770, the contents of which are hereby incorporated by reference. Such dual fluid injection systems implement one fuel metering event per engine cycle.

The fuel metering component, typically a pressure-time injector, within a dual fluid injection system is designed to operate most efficiently within a range of fuelling rates (generally measured in grams per second). This is known as the 'dynamic range' of the fuel metering injector. In practice, the design of the injector requires a degree of compromise to achieve an acceptable dynamic range. For example, in order for a particular engine to operate effectively under high load and/or speed conditions, the dynamic range of the fuel metering injector may need to be set such that engine operation at idle is less than ideal. Similarly, in certain circumstances the maximum power available from an engine may need to be limited to provide acceptable engine performance at low load and/or speed conditions.

The present invention seeks to provide a method of operation of a dual fluid fuel injection system which may be used in some circumstances to increase the dynamic range of the fuel metering injector.

SUMMARY OF THE INVENTION

In accordance with a first aspect of the present invention there is provided a method of operation of a dual fluid fuel injection system arranged to supply fuel to a cylinder of an internal combustion engine, the dual fluid fuel injection system controllable to effect fuel metering events and fuel delivery events, the method comprising operating the dual fluid fuel injection system so as to have at least one fuel delivery event during each engine cycle and to have fewer than one fuel metering event, on average, per engine cycle.

The dual fluid fuel injection system may include a fuel metering injector and a separate fuel delivery or air injector, both injectors usually being solenoid operated. The fuel metering injector meters a predetermined quantity of fuel, in a fuel metering event, which the fuel delivery or air injector delivers directly into a cylinder of the engine in a delivery or air event. This delivery or air event is facilitated by a quantity of compressed gas, typically air, which is supplied through the delivery or air injector into the cylinder, with the metered quantity of fuel being delivered by and entrained in the supplied air.

For such a dual fluid fuel injection system, the method provides special modes of operation to be employed at each end of the fuel metering injector's dynamic range to extend that dynamic range. Typically, one end of the fuel metering injector's dynamic range is low load/speed engine operating conditions;

and the other end of the fuel metering injector's dynamic range is high load/speed engine operating conditions. Low engine load and high engine load are relative terms understood by persons skilled in the art. As a general guide, low engine load can be considered to be less than or equal to 25% of maximum load for a particular engine speed. Similarly, high engine load can be considered to be greater than or equal to 75% of maximum load at the particular engine speed.

The invention has arisen in response to an understanding of the limitations of known fuel metering injectors. These limitations relate to the electro-mechanical operation of such injectors, and also to the phenomenon of fuel 'hang up' within the delivery injector of a dual fluid injection system.

As with all electro-mechanical, solenoid operated devices, the switching 'on' and 'off' of the fuel metering injector is not a trivial operation. The 'turn-on' of the device requires a given amount of electrical current (generally higher than that required to maintain the device in an open position), and also requires a certain period of time before it is physically opened. Similarly, the 'turn-off' of the fuel metering injector requires a certain period of time before the injector is physically closed. At the low end of engine operation (i.e. typically idle, and some low load and/or speed operating points), the amount of fuel delivered during the 'turn-on' and 'turn-off' periods alone may be more than that required by an engine cylinder during a single cycle of engine operation. An Electronic Control Unit (ECU) may thus send a 'close' signal before the device has completed opening. Conversely, at the high end of engine operation (i.e. such as at maximum load and/or speed operating points), the need to 'rest' the fuel metering injector in the 'off' position in order to prevent heat build-up (i.e. from the higher opening currents) can limit the amount of fuel which is able to be provided to an engine cylinder during an engine operating cycle.

Fuel 'hang-up' generally refers to the problem that, during normal operation of a dual fluid injection system, the total amount of metered fuel supplied to the delivery or air injector is not delivered in its entirety during a corresponding fuel delivery or air injection event for an engine cylinder. A certain amount of fuel typically remains in the fuel injection system, typically within the delivery or air injector, due primarily to wetting of surfaces and associated surface tension effects.

In a first mode of operation, the present invention seeks to take advantage of this phenomenon by using a single fuel metering event to provide fuel for more than one engine cycle. For example, under low load/speed engine operating conditions, such as idle, one fuel metering event may provide fuel for a plurality of engine cycles, for example every two, three or possibly more engine cycles. This arises from the realisation that the quantity of fuel which remains in the fuel injection system due to the above described 'hang-up' effect may be sufficient for delivery into the cylinder and successful combustion in a subsequent engine operating cycle.

For the first mode of operation, some control or calibration may be necessary to avoid problems of combustion instability due to delivery of differing quantities of fuel over successive engine cycles, particularly engine cycles occurring under the same engine operating conditions. Calibration of the first mode of operation may be done by the ECU controlling operation of the fuel injection system, for example as described below. Alternatively, in a second and preferred approach, the relative length of the fuel delivery (air injection) events may be controlled, being altered if necessary, to enable fuelling rates to be reasonably consistent during successive engine operating cycles. To that end, relative length of fuel delivery events may be controlled to apportion quantity of fuel delivered to a cylinder, as equally as possible or as otherwise required for smooth engine operation, between successive engine cycles. A different control strategy may be adopted if engine operating conditions change.

In a second mode of operation, the present invention takes advantage of the fact that the current required to maintain the fuel metering injector in an open position is typically less than that required to 'turn-on' the injector. If the fuel metering injector is maintained in an open position, considerably less heat is generated in the solenoid than is generated by opening and closing of the device. The invention proposes, therefore, maintaining the fuel metering injector in an open position for more than a single engine cycle, with the delivery or air injector continuing to deliver fuel (entrained in air) into the engine cylinder during each engine operating cycle. That is, a single fuel metering event extends for a plurality of engine cycles overlapping with fuel delivery events occurring during said plurality of engine cycles. This will enable the delivery of larger quantities of fuel than would be possible if the fuel metering device was required to open, close and rest during each engine cycle.

Significant benefits may be gained by maintaining the fuel metering injector open across one or more additional engine operating cycles; that is, for an additional 360° of crank angle for a two-stroke engine or 720° of crank angle for a four-stroke engine. The invention envisages that the fuel metering device may be maintained continuously opened across several engine cycles, or even for indefinite duration, during periods of high engine load. This will provide the maximum possible quantity of fuel available for each delivery or air injection event.

A further aspect of the invention provides an electronic control unit (ECU) for controlling the dual fluid fuel injection system to effect fuel metering events and fuel delivery events, the control unit being configured with maps for controlling operation of the dual fluid fuel injection system so as to have at least one fuel delivery event during each engine cycle and to have fewer than one fuel metering event, on average, per engine cycle.

The ECU may calibrate the first mode of operation using 'maps'. The ECU operates the engine using a different map for each successive engine cycle where difference in quantity of fuel delivered to a cylinder in fuel delivery events over two successive engine cycles exceeds a predetermined value. Taking two engine cycles as an example, two such ECU maps may be operated—one for the first engine cycle, which will generally have a larger quantity of fuel supplied, and one for the second engine cycle. In such circumstances, the ECU may recalculate a map for controlling operation of said dual fluid injection system each said successive engine cycle.

BRIEF DESCRIPTION OF THE DRAWINGS

It will be convenient to further describe the invention with reference to preferred embodiments of the method of the present invention. Other embodiments are possible, and consequently, the particularity of the following discussion is not to be understood as superseding the generality of the preceding description of the invention. In the drawings.

DESCRIPTION OF PREFERRED EMBODIMENT

Figure 1:
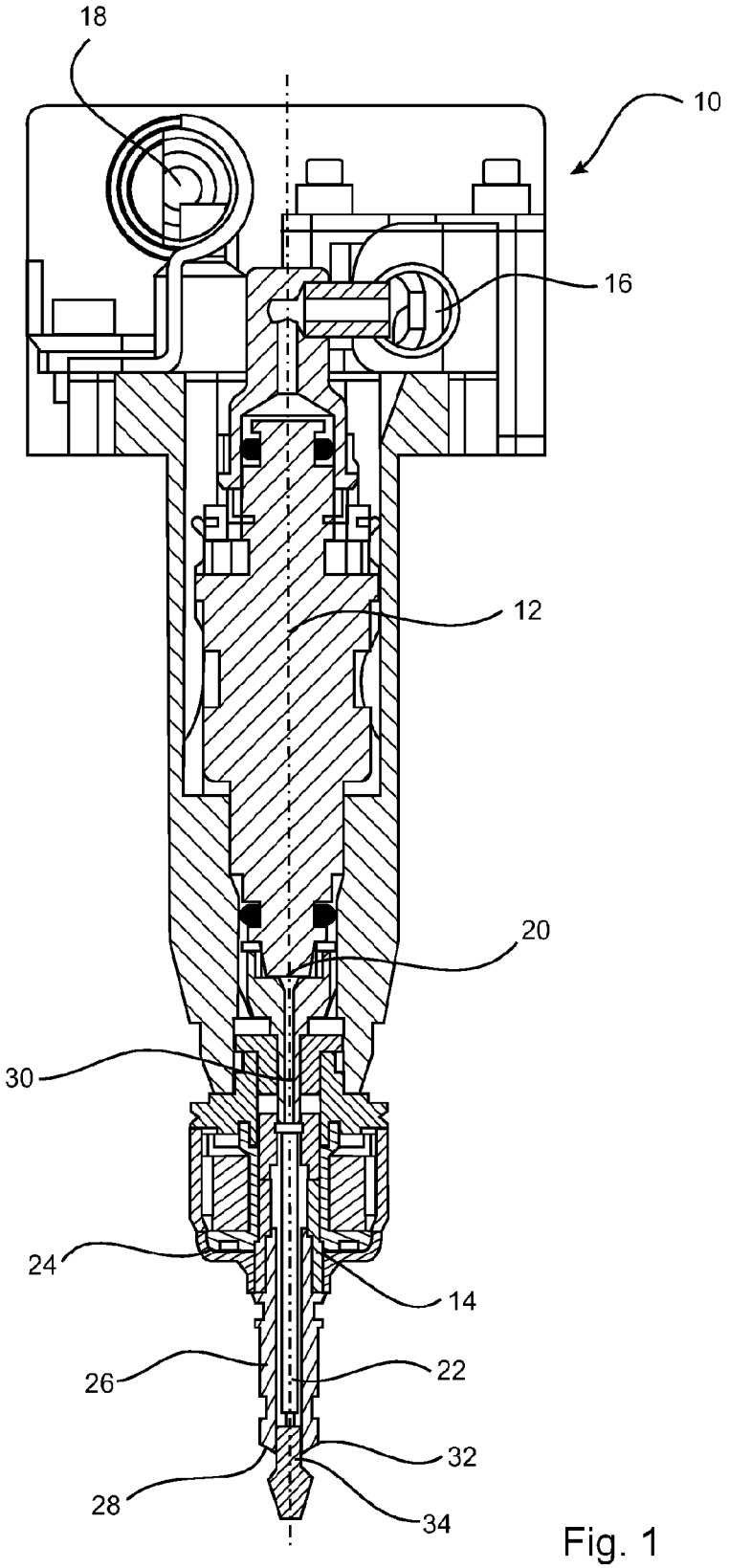
FIG. 1 is a schematic representation of a dual fluid direct injection (DI) system which can be used in the manner of the present invention.

Referring to FIG. 1, there is shown a dual fluid direct injection (DI) system 10, similar to that described in the Applicant's U.S. Pat. No. 4,800,862 for delivery of fuel to a cylinder of an engine whether of single or multi-cylinder type. The fuel injection system 10 has two key components, a fuel metering injector 12 and a delivery or air injector 14. The fuel injection system 10 is supplied by a fuel duct 16 and an air duct 18.

The fuel metering injector 12 has a metering nozzle 20 which is in fluid communication with a chamber 22 formed within a valve stem of the air injector 14.

The delivery or air injector 14 has a housing 24 with a cylindrical spigot 26 projecting from a lower end thereof, the spigot 26 defining an injection port 28 communicating with a passage 30 fluidly connected to the chamber 22. The injection port 28 includes an injection nozzle 32, having a solenoid operated selectively openable poppet valve 34 operating in a manner similar to that described in the Applicant's U.S. Pat. No. 4,934,329, the contents of which are hereby incorporated by reference.

In normal operation, during each engine cycle, the fuel metering injector 12 is opened, in a fuel metering event, for a period of time corresponding to the fuel required in the cylinder for the current engine load demand. Fuel flows through the fuel metering injector 12 into the chamber 22. Once the desired quantity of fuel has been metered, the fuel metering injector 12 closes.

When the appropriate point of the engine cycle is reached, the poppet valve 34 is opened to effect delivery of the metered quantity of fuel into the cylinder. As the delivery or air injector 14 is in communication with a source of compressed air (such as a compressor (not shown)) via the air duct 18, the metered fuel is entrained by and delivered into the cylinder by a quantity of air. The bulk of the metered fuel contained within the chamber 22 is delivered into the engine cylinder, except for that which is retained due, for instance, to wetting of internal surfaces (i.e. hang-up fuel) and associated surface tension effects.

When the engine load is particularly low though stable, such as at idle, the present invention proposes operating in a different mode. Three examples of this mode are shown in FIG. 2.

Figures 2A, 2B, 2C:
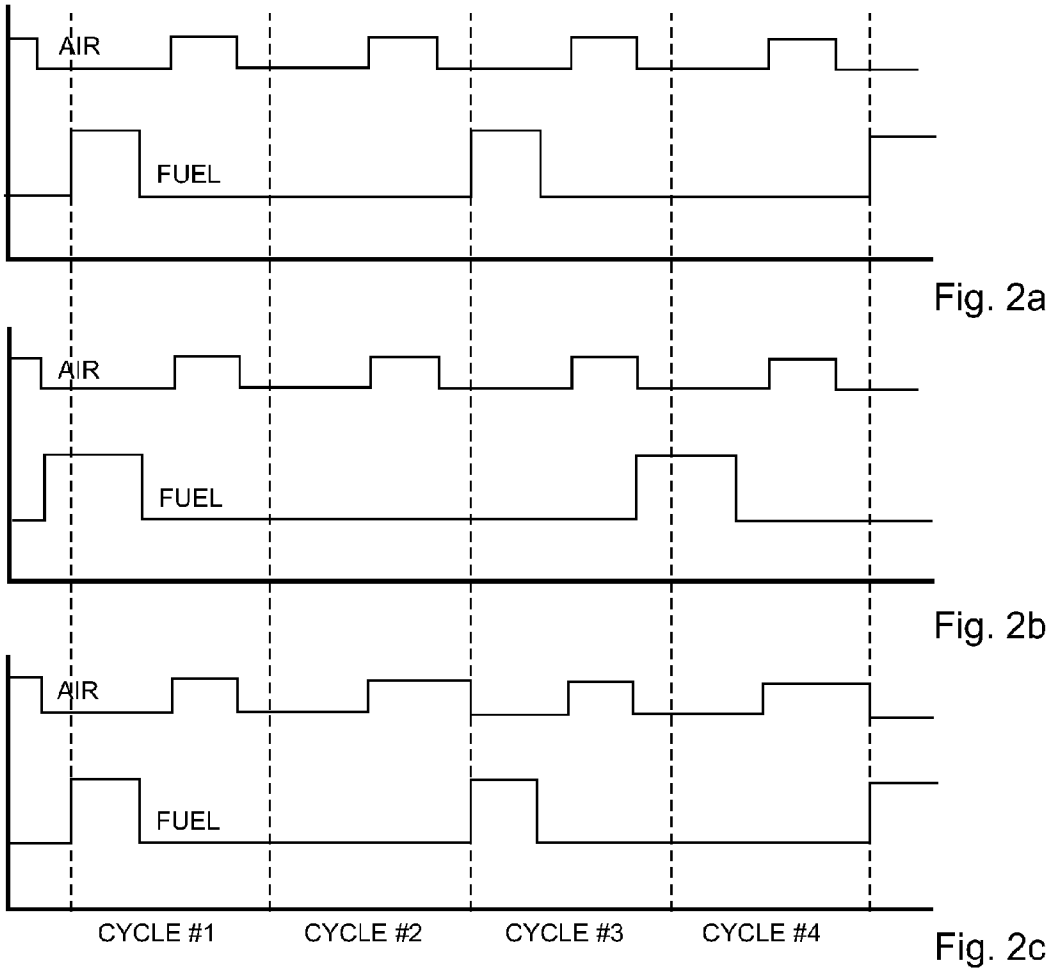
FIG. 2*a* is a plot of timings of a dual fluid DI system operating in accordance with a first embodiment of the first mode of the present invention.
FIG. 2*b* is a plot of timings of a dual fluid DI system operating in accordance with a second embodiment of the first mode of the present invention.
FIG. 2*c* is a plot of timings of a dual fluid DI system operating in accordance with a third embodiment of the first mode of the present invention.

FIG. 2*a* shows the poppet valve 34 of the delivery or air injector 14 being operated according to a usual pattern (i.e. opening in a fuel delivery event once each engine operating cycle), with the fuel metering injector 12 being operated only every second engine cycle. FIG. 2*b* shows the poppet valve 34 of the air injector 14 again being operated according to the same usual pattern, with the fuel metering injector 12 being operated only every third engine cycle, albeit for a slightly longer duration.

FIG. 2*c* shows the fuel metering injector 12 being operated on every second engine cycle, as in FIG. 2*a*, but with the poppet valve 34 of the delivery or air injector 14 initially being opened for a relatively short duration during the engine cycle within which the fuel metering injector 12 is opened, and then for a relatively longer time span during the subsequent 'off' cycle for the fuel metering device 12.

Figure 3:
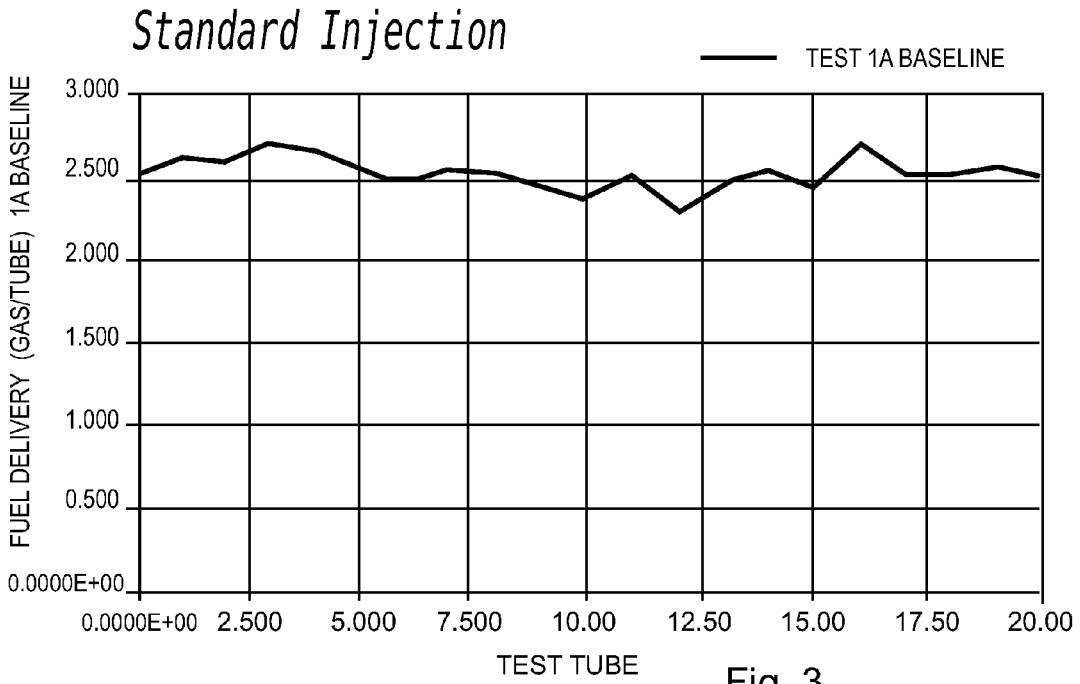
FIG. 3 is a plot of fuel delivery into a cylinder using a dual fluid DI system operating in a traditional manner.
Figure 4A:
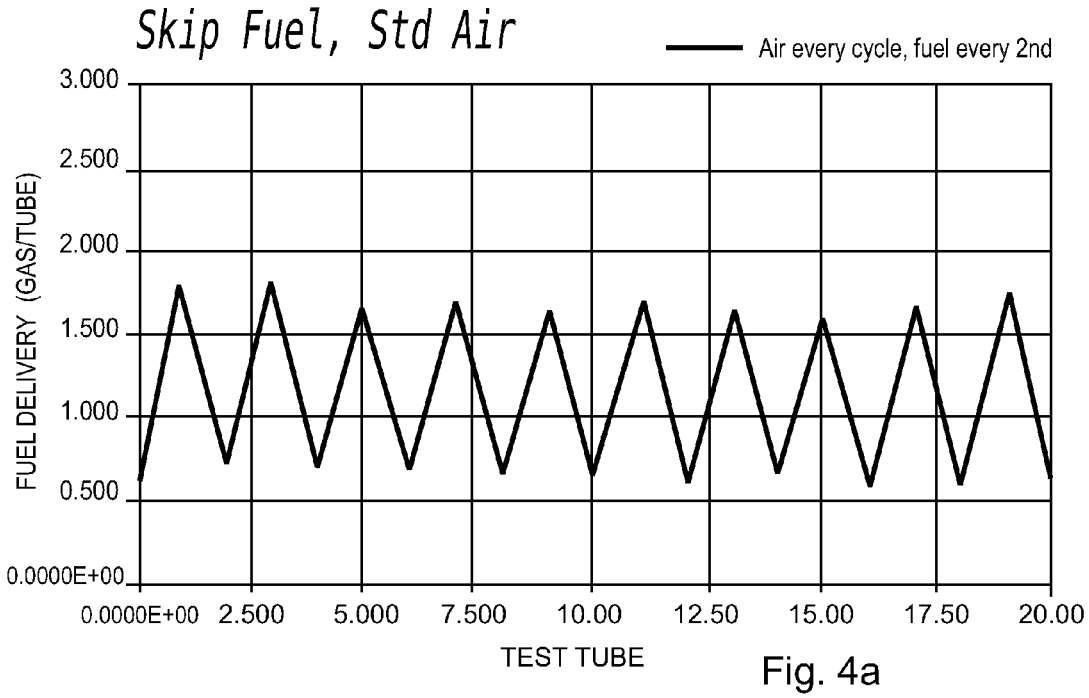
FIG. 4*a* is a plot of fuel delivery into a cylinder using a dual fluid DI system operating as shown in FIG. 2*a;*
Figure 4B:
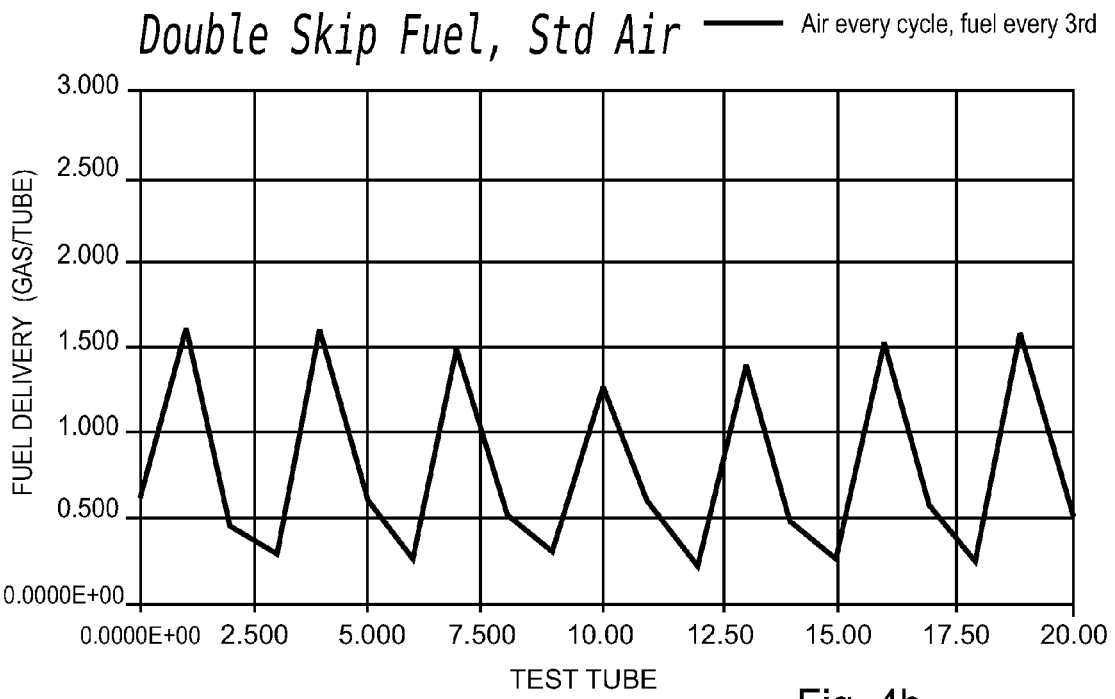
FIG. 4*b* is a plot of fuel delivery into a cylinder using a dual fluid DI system operating as shown in FIG. 2*b;*
Figure 4C:
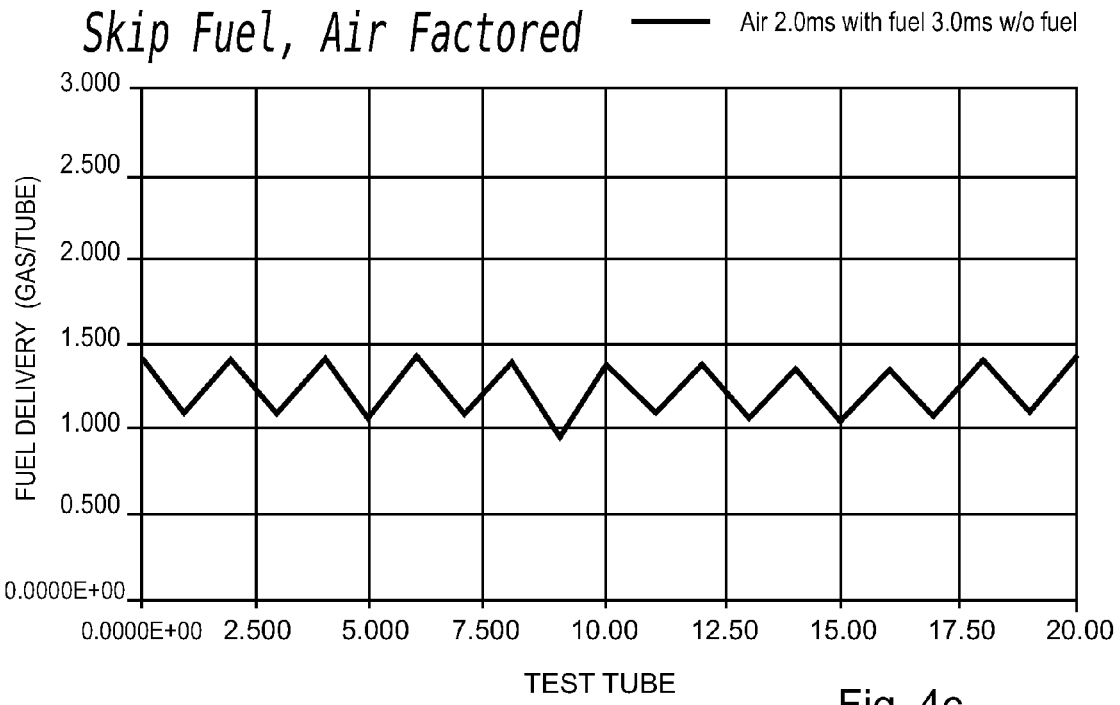
FIG. 4*c* is a plot of fuel delivery into a cylinder using a dual fluid DI system operating as shown in FIG. 2*c;*

The results of these modes of operation are shown in FIGS. 4*a-c*. These results are in comparison with FIG. 3, which shows the corresponding results for the fuel injection system 10 when operating in a traditional manner.

Each of the FIGS. 3 and 4*a-c* show a plot of the fuel delivered through the poppet valve 34 into the engine cylinder over successive opening (fuel delivery) events. As can be seen in FIG. 3, during normal operation, each opening of the poppet valve 34 of the delivery or air injector 14 resulted in the delivery of about 2.5 g of fuel. It can be inferred from this that the fuel metering injector 12 thus supplied about 2.5 g of fuel for each fuel delivery event, since the fuel metering injector 12 opens once per engine cycle.

In FIG. 4*a*, it can be seen that the same quantity of fuel (2.5 g) supplied by each opening of the fuel metering injector 12 was divided between two successive openings (fuel delivery events) of poppet valve 34 of delivery or air injector 14 corresponding with fuel delivery events at a frequency of one per engine cycle. About 1.75 g of fuel was delivered by the air injector 14 during the first fuel delivery event, and the remaining 0.75 g was delivered by the air injector 14 during the successive or second fuel delivery event. From this 'skip-fuelling' mode of operation, it can be inferred that about 30% of the fuel metered by the fuel metering injector 12 remained in the chamber 22 within the delivery or air injector 14 subsequent to the first opening of the poppet valve 34.

In FIG. 4*b*, it can be seen that only about 1.6 g of fuel was delivered into the engine cylinder during the first opening of the poppet valve 34 of delivery or air injector 14, about 0.5 g was delivered during the second opening event, and about 0.4 g was delivered in the third opening event. From this 'double skip-fuelling' mode of operation, it can be inferred that a certain amount of 'wetting' fuel remains even after two successive air injection events have occurred.

In operating an engine using either the embodiment as described with reference to FIG. 2*a* or 2*b*, it may be necessary to provide a separate ECU map for each engine cycle, or recalculate the ECU map, as there is a significant difference in the quantity of fuel delivered into the engine cylinder over successive engine operating cycles. Although this requires significant computational speed within the ECU, it is anticipated that if this computational speed is available, the engine will still be able to run smoothly under these conditions.

FIG. 4*c* shows a much more even distribution of delivered fuel between two successive engine cycles, with about 1.4 g being injected in a first opening of the poppet valve 34 of the delivery or air injector 14 (corresponding to first engine cycle) and about 1.1 g being injected in a second opening event (i.e. second engine cycle, the duration of the second opening event being controlled by the ECU to be of greater duration than the first opening event as a strategy for apportioning fuel delivery as equally as possible between the two successive engine). These results are sufficiently close that recalculation of the ECU map for each engine cycle will not be required. Furthermore, these first and second fuel delivery quantities may be better matched with further optimisation of the poppet valve 34 duration and desired combustion stability. This embodiment is thus preferred for the tested fuel injection system 10. It can be inferred that the longer poppet valve opening time is more effective at clearing out any fuel hang-up on wetted surfaces than the shorter opening times of FIGS. 2*a* and 2*b*. This result is, of course, contingent on the specific geometry of the tested delivery injector, as well as air pressure and perhaps the properties of the particular fuel and different results are likely to be achieved with different arrangements.

Figure 5:
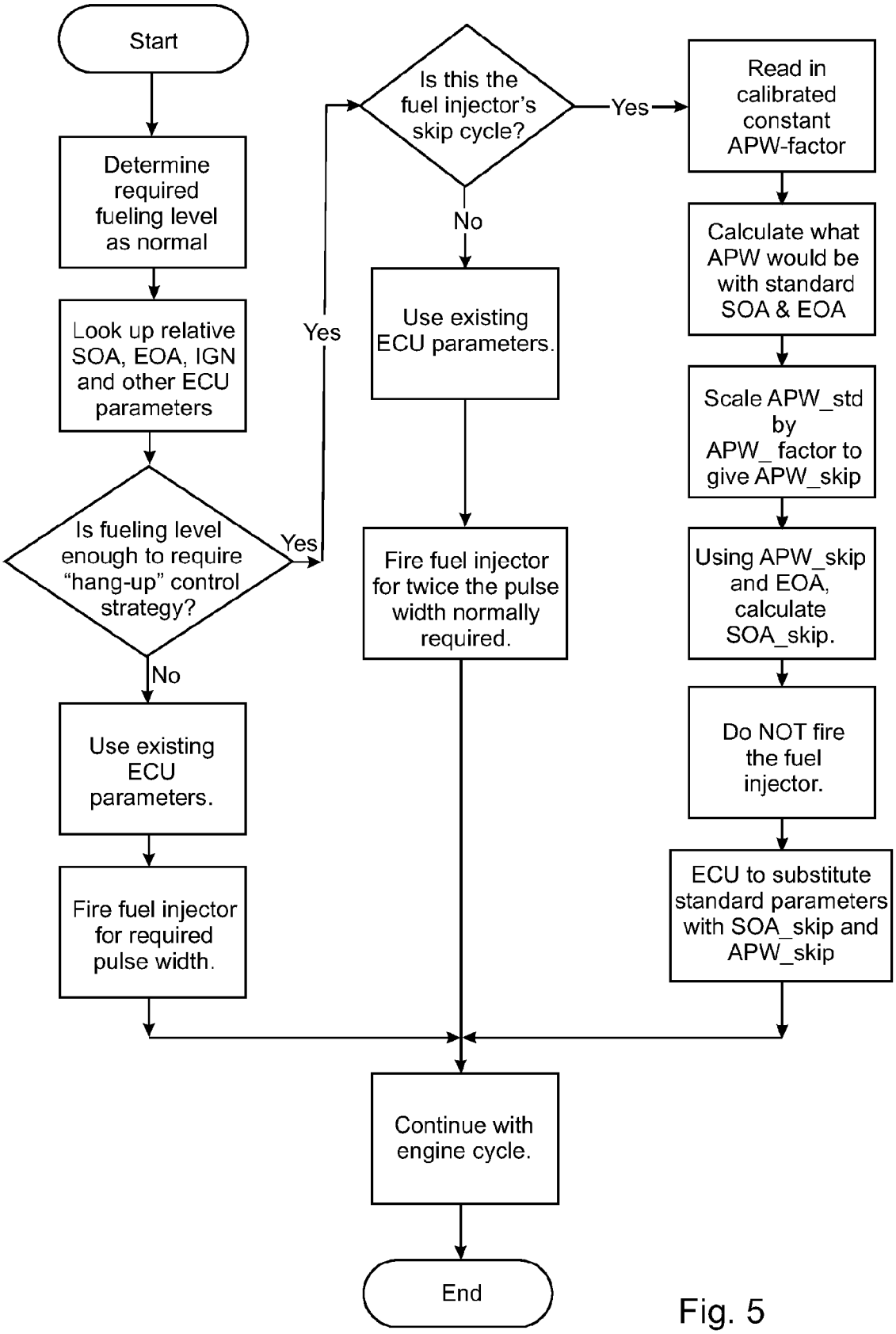
FIG. 5 is a diagram of a possible control strategy for implementing the first mode of the present invention.

FIG. 5 shows one possible control strategy for implementing the embodiment of the invention as described with reference to FIG. 2*c*, this control strategy adopting timings in the crank angle domain for both fuel injection and ignition (IGN). It will be seen that the end (defined by crank angle) of the second air pulse (i.e. the second opening of the poppet valve 34 of the delivery or air injector 14 or EOA) is fixed, and the start of this second air pulse (SOA) is calculated to provide a sufficiently longer fuel delivery pulse, i.e APW.

Figure 6A:
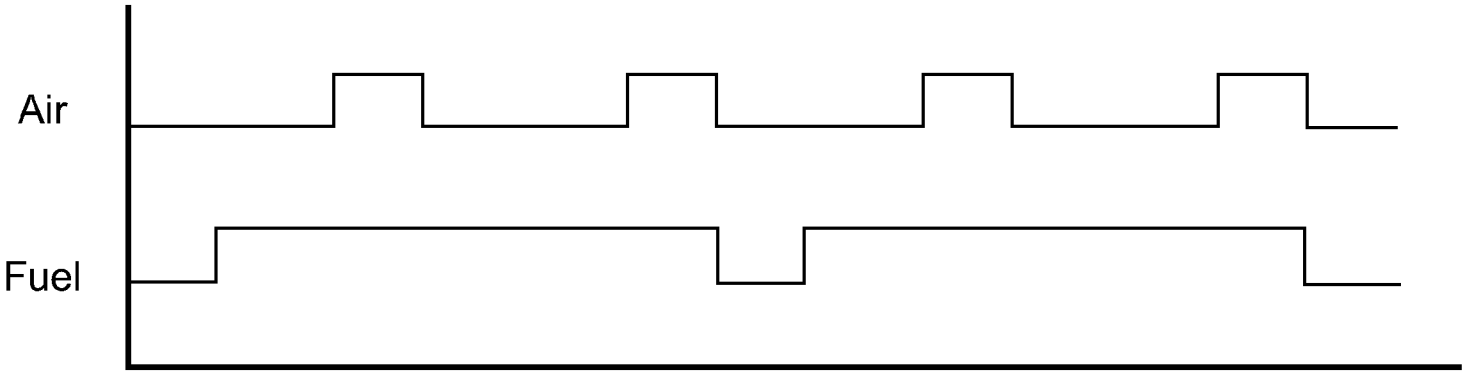
FIG. 6*a* is a plot of timings of a dual fluid DI system operating in accordance with a first embodiment of the second mode of the present invention.
Figure 6B:
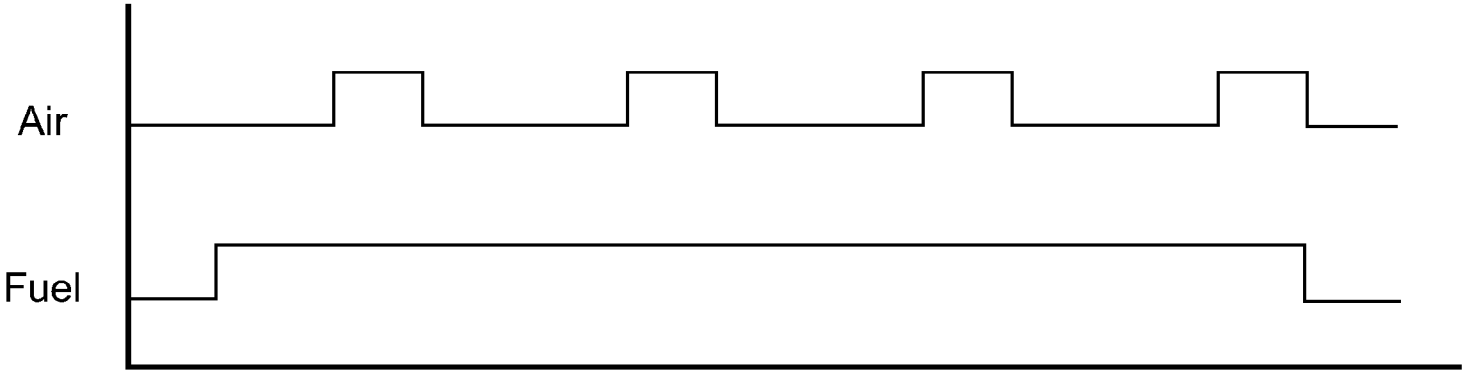
FIG. 6*b* is a plot of timings of a dual fluid DI system operating in accordance with a second embodiment of the second mode of the present invention.

FIGS. 6*a* and 6*b* depict a second mode of operation of the invention where a single fuel metering event may extend for more than two engine cycles, averaging less than one fuel metering event per engine cycle, for example, under high engine load conditions. At the same time, the fuel metering event overlaps with fuel delivery events occurring over the same more than two engine cycles. By operating according to this second mode, the fuel injection system 10 is able to deliver larger quantities of fuel into the engine cylinder than would be possible if the fuel metering injector 12 was required to open, close and rest during each successive engine operating cycle.

FIG. 6*a* shows the poppet valve 34 of the delivery or air injector 14 being operated according to a usual pattern (i.e. opening once each engine operating cycle), with the fuel metering injector 12 being operated and maintained open over two successive engine cycles. Here, a single fuel metering event overlaps with two fuel delivery events.

FIG. 6*b* shows the poppet valve 34 of the delivery or air injector 14 again being operated according to the same usual pattern, with the fuel metering device 12 being operated and maintained open for a much longer duration over four successive engine cycles. Here, a single fuel metering event overlaps with four fuel delivery events.

In each case, the fuel metering injector 12 is left open over multiple engine cycles, with the delivery or air injector 14 operated to effect individual fuel delivery events such that discrete quantities of fuel (entrained in air) are injected directly into the engine cylinder over successive engine operating cycles. In this way, the 'dynamic range' of the fuel metering injector 12 is effectively increased such that the injection system 10 is able to satisfy fuelling requirements at high engine load and/or engine speed conditions without the need to compromise engine performance at idle and low load and/or speed conditions.

Modifications and variations to the invention may be apparent to the skilled reader of this disclosure. Such modifications and variations are deemed within the scope of the present invention.

The invention claimed is:

1. A method of controlling a dual fluid fuel injection system for an internal combustion engine, the dual fluid fuel injection system having a fuel metering injector to meter a quantity of fuel, and a delivery injector arranged to deliver air and at least a portion of the metered fuel to a cylinder of an internal combustion engine, the dual fluid fuel injection system being controlled by an electronic control unit (ECU) to effect fuel metering events and fuel delivery events, the method comprising the steps of:

the ECU controlling the fuel metering injector to effect fewer than one fuel metering event, on average, per engine cycle, to meter a quantity of fuel; and the ECU controlling the fuel delivery injector to effect an air and fuel delivery event to deliver the air and at least a portion of the metered quantity of fuel to the cylinder of the internal combustion engine during each engine cycle.

2. The method according to claim 1 being implemented for low engine load/speed and high engine load/speed engine operating conditions.

3. The method according to claim 1 wherein a single fuel metering event provides fuel for a plurality of engine cycles.

4. The method of claim 3 wherein relative length of fuel delivery events is controlled to apportion quantity of fuel delivered to a cylinder, preferably as equally as possible, between successive engine cycles.

5. The method according to claim 4 wherein the electronic control unit (ECU) uses maps for controlling operation of said dual fluid injection system and where difference in quantity of fuel delivered to a cylinder in fuel delivery events over two successive engine cycles exceeds a predetermined value, said ECU operating the engine using a different map for each successive engine cycle.

6. The method according to claim 5 wherein said ECU recalculates a map for controlling operation of said dual fluid injection system each said successive engine cycle.

7. The method according to claim 3 wherein differing quantities of fuel are delivered through fuel delivery events over successive engine cycles under the same engine operating conditions.

8. The method of claim 3 wherein said engine is operated under low load engine operating conditions.

9. The method according to claim 1 wherein a single fuel metering event extends for a plurality of engine cycles overlapping with fuel delivery events occurring during said plurality of engine cycles.

10. The method of claim 9 wherein said fuel metering event extends for a plurality of engine cycles during periods of high engine load.

11. An electronic control unit (ECU) for controlling a dual fluid fuel injection system arranged to supply air and fuel to a cylinder of an internal combustion engine, the ECU controlling fuel metering events of a fuel metering injector, and the ECU controlling air and fuel delivery events of a delivery injector, the ECU being configured with maps for controlling operation of the dual fluid fuel injection system, wherein the ECU is configured to effect fewer than one fuel metering event, on average, per engine cycle, by controlling the fuel metering injector to meter a quantity of fuel, and to effect a fuel delivery event by controlling the delivery injector to deliver air and at least a portion of the metered quantity of fuel during each engine cycle.

12. The electronic control unit (ECU) of claim 11 wherein said ECU controls the engine using a different map for each successive engine cycle where difference in quantity of fuel delivered to a cylinder in fuel delivery events over two successive engine cycles exceeds a predetermined value.

13. The electronic control unit of claim 11 wherein said ECU recalculates a map for controlling operation of said dual fluid injection system each said successive engine cycle.

14. A method of controlling a dual fluid fuel injection system for an internal combustion engine, the dual fluid fuel injection system having a fuel metering injector to meter a quantity of fuel, and a delivery injector arranged to deliver compressed gas and at least a portion of the metered fuel to a cylinder of an internal combustion engine, the dual fluid fuel injection system being controlled by an electronic control unit (ECU) to effect fuel metering events and fuel delivery events, the method comprising the steps of:

maintaining a fuel metering injector closed during an engine cycle; and controlling the delivery injector during an engine cycle to effect a delivery event to deliver compressed gas and at least a portion of the metered quantity of fuel from a previous fuel metering event by the fuel metering injector to the cylinder.

15. An electronic control unit (ECU) for controlling a dual fluid fuel injection system for an internal combustion engine, the dual fluid fuel injection system arranged to supply fuel and compressed gas to a cylinder of an internal combustion engine, the ECU controlling fuel metering events of a fuel metering injector and delivery events of a delivery injector, the ECU being configured with maps for controlling operation of the dual fluid fuel injection system, wherein the ECU is configured to maintain a fuel metering injector closed during an engine cycle, and to effect a delivery event by controlling the delivery injector to deliver compressed gas and at least a portion of a metered quantity of fuel from a previous fuel metering event by the fuel metering injector to the cylinder.

16. The method of claim 14, wherein the compressed gas includes air.

17. The ECU of claim 15, wherein the compressed gas includes air.

* * * * *